United States Patent [19]

Zamotin

[11] 4,117,561

[45] Oct. 3, 1978

[54] PATIENT LIFT DEVICE

[76] Inventor: Rodvinon I. Zamotin, P.O. Box 721, Miami Springs, Fla. 33166 .

[21] Appl. No.: 677,805

[22] Filed: Apr. 16, 1976

[51] Int. Cl.[2] ..... A61G 7/10

[52] U.S. Cl. ..... 5/83; 5/86; 5/88

[58] Field of Search ..... 5/81 R, 83, 86, 88; 297/DIG. 4

[56] References Cited

U.S. PATENT DOCUMENTS

| | | | |
|---|---|---|---|
| 733,803 | 7/1903 | Black | 5/86 |
| 935,170 | 9/1909 | Smith | 5/81 B |
| 1,700,088 | 1/1929 | Smith et al. | 5/81 B |
| 1,782,406 | 11/1930 | Bureau | 5/86 X |
| 1,878,785 | 9/1932 | Leavitt | 5/86 |
| 2,598,570 | 5/1952 | Lewis | 5/81 B X |
| 2,905,952 | 9/1959 | Reichert et al. | 5/81 |

*Primary Examiner*—Mervin Stein
*Assistant Examiner*—David H. Corbin
*Attorney, Agent, or Firm*—Larson, Taylor and Hinds

[57] ABSTRACT

A movable patient lift device that comprises a lower base assembly, an upstanding post assembly mounted on one end of the base assembly, a cantilever boom assembly, which includes a track, mounted on the upper end of the post assembly and extending longitudinally at the distal end beyond the base assembly, and a movable trolley assembly in movable engagement with and supported by the track. The trolley assembly contains a rotatable drum onto which a flexible cable is wound. A patient chair or sling is attached to the other end of the cable and linkage and gearing is provided to enable an operator to rotate the drum thereby raising or lowering the patient, and to longitudinally position the trolley assembly and hence the patient along the track. A cantilever platform is pivotally mounted to the base assembly and extends outwardly therefrom, preferably in the direction opposite that of the boom assembly. When an operator mounts the platform, the operator counterbalances the moment exerted by a patient who is suspended beyond the base assembly.

10 Claims, 3 Drawing Figures

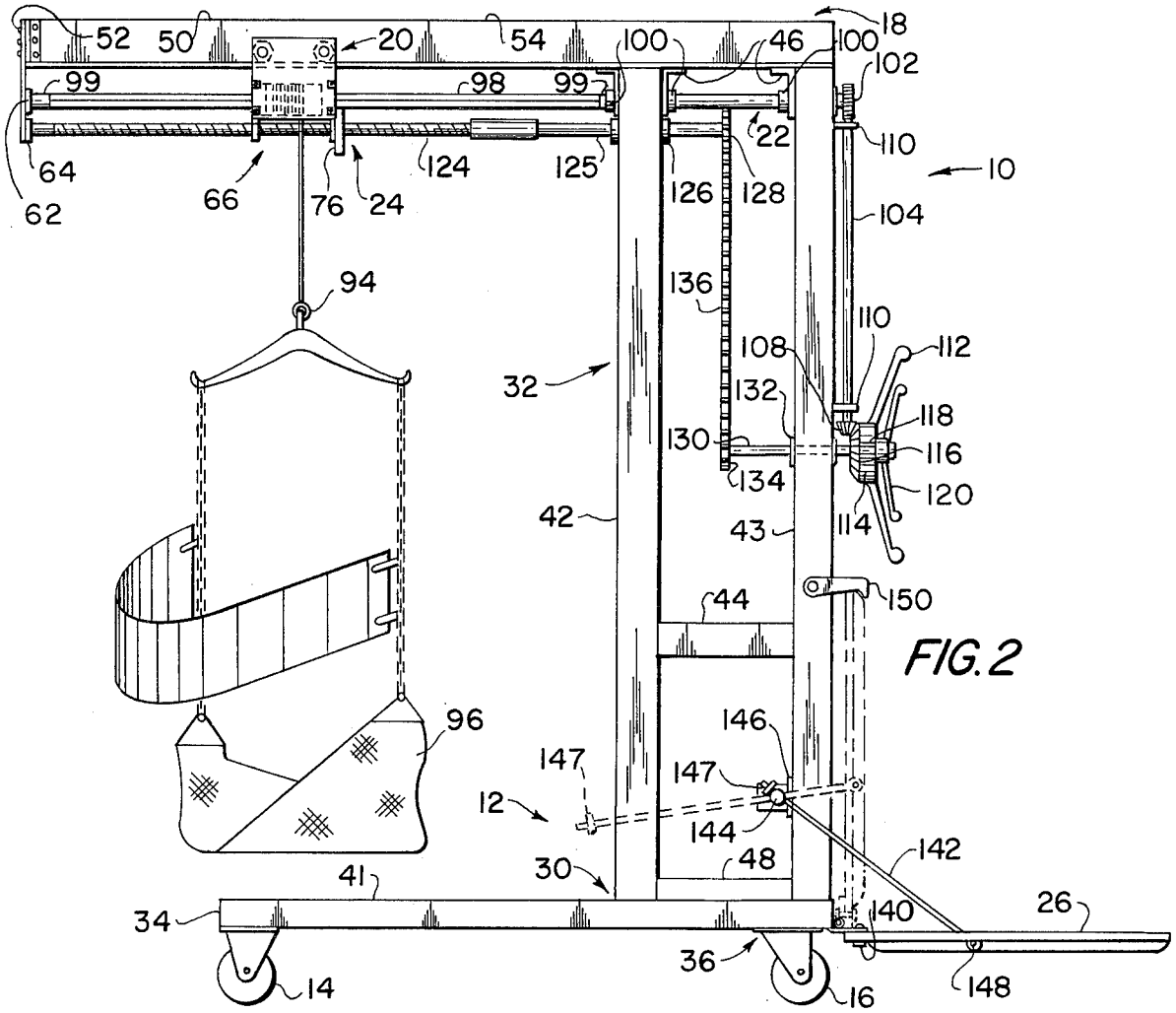
FIG. 2
FIG. 3
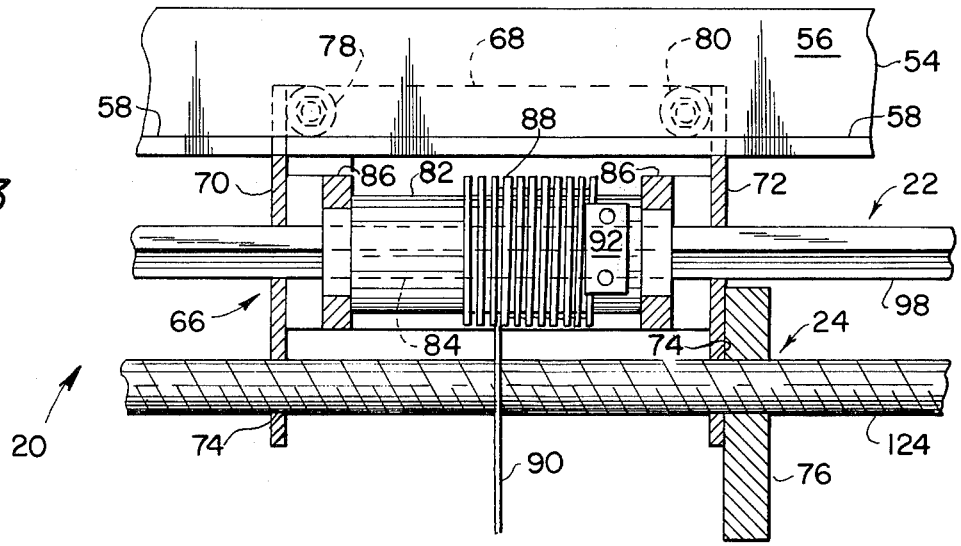

PATIENT LIFT DEVICE

FIELD OF THE INVENTION

The present invention relates to a lifting and transporting device. More specifically, the present invention relates to a device for lifting and transporting invalids or bedridden patients, preferably with a minimum of assistance.

BACKGROUND OF THE INVENTION

There are numerous mobile patient lift devices disclosed in the prior art which are used to move or transport invalids, bedridden-patients, or wheelchair confined patients from one area of a hospital or home to another area. Often the patients must be deposited on a table for physical therapy or into a tub for water therapy treatment or bathing. One problem encountered with conventional patient lift devices is that a patient cannot be deposited beyond the area defined by the base of the device. Although depositing a patient on a table or a chair which can be positioned within the frame of the device creates no problem, the conventional patient lift devices cannot be used for depositing a patient into a bathtub or onto a similar object such as a table that has a vertical wall extending upwardly from the floor so as to prevent positioning that object within the area defined by the base of the lift. With these previous mobile lifters, it was necessary, when lifting a patient onto or into such an object, to use, in combination with the mobile lifters other devices such as T-shaped frames or the like permanently, pivotally mounted near the base of the object such as the bathtub.

Another problem associated with known conventional patient lift devices is that the devices are difficult for one person to operate, or are relatively fragile and, because of their narrow bases, are subject to instability. Still further prior art lift devices suffer from the disadvantage of having excessive gadgetry and complex pivoting and moving mechanisms, and these devices are either very expensive, or are subject to frequent breakdowns.

Typical prior lift devices having the above noted structures, with the attendant disadvantages, are shown and described in the following U.S. Patents: Averill, No. 3,711,877; James, No. 3,829,916; Brown, No. 3,877,421; Bunker, No. 1,971,294; Kral, No. 3,123,244; Allen, No. 1,061,715; and Higgins, No. 787,760.

Hence, there exists a need for providing a new and improved patient lift structure which will overcome the problems which have existed heretofore.

SUMMARY OF THE INVENTION

The present invention overcomes these and other disadvantages of the prior art by providing a patient lift device that can safely transport a patient beyond the frame support area a sufficient distance so as to enable a patient to be lowered onto or into an object located outside the area defined by the supporting base of the lift device. Moreover, the present invention accomplishes the foregoing without the need for transferring the patient between the mobile lift device and other devices and without any attachments or external equipment. With the present invention, a patient can be simply and efficiently lifted from one location, moved directly to another location and deposited gently and smoothly onto or into an object at a second location. The controls of the present invention are comprised of simple mechanical elements that are compact, inexpensive, simple in design to prevent breakdown, rugged to prevent breakage, and easily operated by a single operator.

In one embodiment of the invention there is provided a movable patient lift device comprising a support assembly, an elongate substantially horizontal boom assembly supported by the support assembly and extending in a first longitudinal direction beyond a support area defined by the support assembly. A movable suspension means for suspending a means for carrying a patient is carried by the boom assembly. The suspension means includes a vertical adjustment for vertically moving the patient carrying means. A horizontal adjustment means mounted to the boom assembly horizontally transports the suspension means along the boom assembly and outside the area defined by the support base. Attached to the support assembly and extending beyond the support area, preferably in the other longitudinal direction, is a stabilizing means for counterbalancing the weight of the patient when the suspension means is moved beyond the support area.

It is an object of this invention to provide a new and improved patient lift device.

It is a further object of this invention to provide a new and improved patient lift device capable of transporting a patient, without the need for additional equipment, onto or into an object located beyond the area defined by the base of the lift device.

It is still another object of this invention to provide a new and improved patient lift device having a boom from which the patient holding seat is hung, which extends beyond the area defined by the base, in combination for counterbalancing excessive weights located beyond said area.

It is still another object of this invention to provide a rugged and simplified patient lift device adapted to be easily operated by a single operator.

Other features and advantages of the present invention will be discussed in or apparent from the description of the preferred embodiment of the invention found hereinbelow.

BRIEF DESCRIPTION OF THE DRAWINGS

FIG. 2 is a side elevation of the lift device shown in FIG. 1 with certain parts cut away and other elements shown in phantom and further shows a sling for holding a patient;

FIG. 3 is an enlarged drawing of a portion of FIG. 2 with parts removed showing the details of a suspension means for suspending a patient according to the present invention.

DETAILED DESCRIPTION OF THE PREFERRED EMBODIMENT

Figure 1:
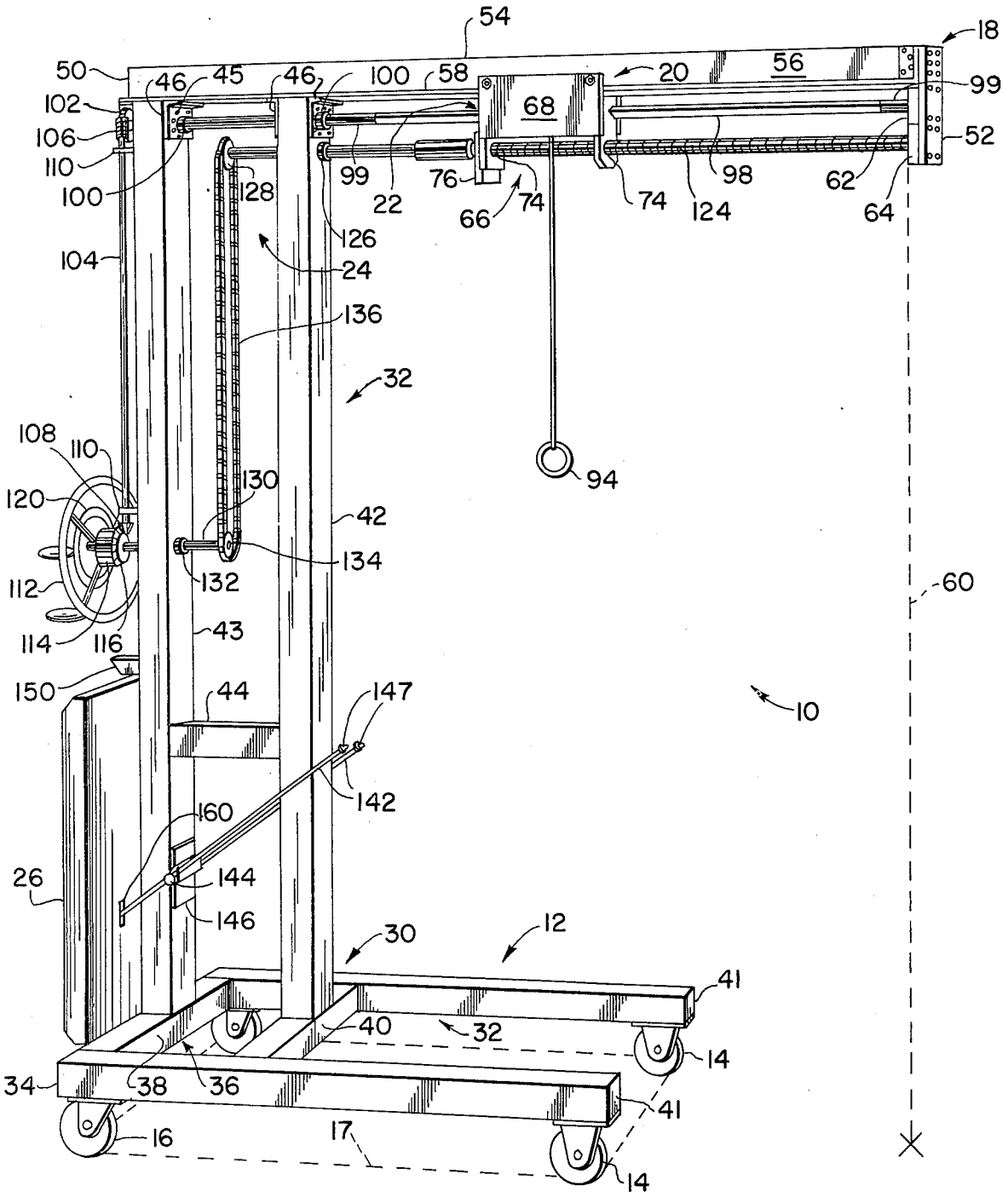
FIG. 1 is a perspective view of a lift device according to the present invention.

With reference to the figures in which like elements are represented by the same number, a patient lift device 10 according to the present invention is depicted. Lift device 10 generally comprises a support assembly 12 that has attached thereto a pair of front castors or wheels 14 and a pair of rear castors or wheels 16 thereby permitting movement of lift device 10 along a supporting surface. As shown in dashed lines in FIG. 1, front and rear wheels 14 and 16 outline the periphery or outer perimeter of a support area 17. In accordance with well known physical laws of mechanics, so long as the combined center of gravity of lift device 10 plus a patient being carried thereby remains within support area 17, lift device 10 will remain stable and not tip over.

Lift device 10 further comprises an elongate, substantially horizontal boom assembly 18 supported by support assembly 12 at its rear end and extending beyond support area 17 at its forward end. A movable patient support or suspension assembly 20 is carried by boom assembly 18 and comprises a vertical adjustment assembly 22 for vertically moving a patient being carried by lift device 10. Suspension assembly 20 and hence a patient suspended therefrom is horizontally transported along boom assembly 18 both within and beyond support area 17 by a horizontal adjustment assembly 24. Attached to support assembly 12 and extending beyond support area 17 in the rearward direction is a cantilever platform 26 for stabilizing lift device 10 and counterbalancing the weight of a patient when suspension assembly 20 is moved along boom assembly 18 beyond and outside of support area 17.

Support assembly 12 comprises a lower base assembly 30 and an upstanding post assembly 32 mounted at one end thereof to base assembly 30. Base assembly 30 comprises a substantially horizontal U-shaped frame 34 that is comprised of a rearward transverse beam 38 and a mid-transverse beam 40 and two longitudinally extending, substantially parallel arms 41. Post assembly 32 is rigidly mounted at approximately the transverse center of base 36 and can be permanently attached thereto by, for example, welding or can be removably attached thereto with bolts and angle members (not shown). Post assembly 32 comprises a front post 42, a rear post 43 and a horizontal brace 44. Removably and rigidly mounted at the top of posts 42 and 43 with screws 45 and angle braces 46 is boom assembly 18. Thus, in one embodiment of the invention, lift device 10 can be substantially disassembled for storage or transportation. Alternately, post assembly 32 can be comprised of a single vertical post which can be removably mounted into and rigidly attached to a short tube that in turn is welded or otherwise permanently attached to base 34. Support assembly 12 can also include a storage shelf 48, shown in FIG. 2 above and extending transversely between arms 41 of frame 34. Alternately, platform 48 could be mounted above or adjacent to horizontal brace 44.

Boom assembly 18 comprises a substantially horizontal cantilever boom 50 rigidly mounted at the rearward end to the post assembly with angle braces 46 and screws 45 as described above. An end plate 52 is attached to the forward end of boom 50 and extends therebelow. In the presently disclosed embodiment of the invention, boom 50 is an inverted T-bar track 54 that consists of a central vertical portion 56 and a lower horizontal portion 58. Alternately, track 54 could be rigidly attached to boom 50. As shown in FIG. 1, a dashed line 60 drawn vertically downward from the rearward face of end plate 52 terminates on the ground at a point well outside support area 17. Rigidly mounted onto the rearward face of end plate 52 is an upper bearing block 62 and a lower bearing block 64, the purposes for which will be described hereinbelow.

Movable patient suspension assembly 20 comprises a travelling trolley assembly 66 mounted on and movable over track 54. With reference in particular to FIG. 3, trolley assembly 66 comprises two spaced apart side plates 68 and two spaced apart end plates, a forward end plate 70 and a rearward end plate 72. Each end plate has an orifice 74 at the lower end thereof, said orifices being colinearly aligned with each other. Mounted on rearward end plate 72 is a threaded Whitworth nut 76, the threaded orifice of which is colinearly aligned with said orifices 74.

Rotatably mounted at the upper ends on the inside of each side plate 68 is a forward roller or wheel 78 and a rear roller or wheel 80 in rolling engagement with the upper side of horizontal portion 58 of track 54. Wheels 78 and 80 of each side plate 68 are on the corresponding side of vertical portion 56 of track 54.

As shown in both FIGS. 2 and 3, vertical adjustment assembly 22 comprises a drum 82 having a square central bore completely therethrough and round ends with reduced diameters journalled in bearing blocks 86 mounted on respective end plates 70 and 72. Drum 82 has external deep threads 88 for guiding and retaining a flexible cable 90, one end of which is secured to drum 82 with a lock plate 92 mounted with screws to one end of drum 82. The other end of flexible cable 90 terminates in a ring 94 to which can be attached, as shown in FIG. 2, a sling 96 for holding a patient. Sling 96 is not a part of the present invention and any supporting device for comfortably, yet securely, holding a patient such as a chair can be substituted therefor.

Vertical adjustment assembly 22 also comprises a drum rotating means comprised of an elongate member or square shaft 98 having rounded end portions 99. The forward end portion 99 of square shaft 98 is journalled in upper bearing 62 and the other end passes through the upward portions of post members 42 and 43 and is journalled thereat in bearings 100. Rigidly mounted on the rearward end of square shaft 98 is a gear 102. A vertical shaft 104 having a worm gear 106 in geared relationship with gear 102 at one of its ends and a miter or bevelled gear 108 on its other end transfers the rotation from an outer, large hand wheel 112 to square shaft 98. Support braces 110 are rigidly attached to the rearward side of post member 43 and rotatably mount vertical shaft 104 thereto. Large hand wheel 112 is comprised of a hub 114 with bevel gear 116 rigidly mounted at the forward end thereof and it has a bore completely therethrough. A bearing 118 is mounted inside the bore of hub 114 so that outer hand wheel 112 can be rotatably mounted on a smaller, inner hand wheel 120 as described hereinbelow.

Horizontal adjusting assembly 22 comprises a Whitworth threaded shaft 124 that is journalled at the forward end thereof in lower bearing block 64 with the rearward end rigidly coupled to a round unthreaded extension shaft 125. Extension shaft 125 extends through an orifice in post member 42 and is rotatably supported by a bearing 126 mounted on post member 42. The rearward end of extension shaft 125 terminates in a sprocket 128. A shaft rotation means for shaft 124 comprises smaller hand wheel 120, and a horizontally extending shaft 130 rigidly mounted at one end thereof to smaller hand wheel 120 and supported in a bearing 132 located in an orifice in rear post member 44. The forward end of shaft 130 terminates in a sprocket 134 which is rotatably connected to and drives sprocket 128 attached to extension shaft 125 by means of an endless chain 136. Larger hand wheel 112 is concentrically, rotatably mounted on shaft 130 at a point just forward of smaller hand wheel 120.

The rotation of large hand wheel 112 is transferred to square shaft 98 through vertical shaft 104 and the associated gearing and to drum 82 as a result of the mating engagement between square shaft 98 and the square central bore 84 of drum 82. Drum 82 also can be keyed to a rotating shaft and still be left free to move axially along the shaft with other obvious mechanisms. For example, shaft 98 can be round and have a straight keyway running axially along the shaft, and a key rigidly mounted in the bore of drum 82 can slidably engage the keyway.

An obvious modification that is still within the present invention is to employ a channel type track with wheels 78 and 80 of trolley assembly 20 mounted on the outer surfaces of side plates 68. Threaded shaft 124 would then be located above square shaft 98 inside the channel of the channel track and nut 76 would extend between side plate 68 and in threaded engagement with threaded screw 124. Other modifications of a channel-type track are disclosed in the aforementioned Kral patent.

The gearing mentioned above which transfers the rotation from hand wheels 112 and 120 to square shaft 98 and threaded shaft 124 respectively are sized so as to provide a mechanical advantage thereby requiring less effort by the operator when turning the respective hand wheel. Similarly, the use of threaded screw 124 provides a further mechanical advantage and results in a very easily operated lift device. Alternatively, reversible electric motors can be mounted between post members 42 and 43 and geared to operate threaded shaft 124 and square shaft 98. The motors could be powered from a battery located on storage shelf 48 and operational switches can be mounted on the rearward side of post member 43 where hand wheels 112 and 120 are now depicted.

With reference to FIG. 1 and particularly to FIG. 2, platform 26 is rotatably mounted with hinges 140 to the rearward end of base assembly 30 of support assembly 12. Platform 26 is supported in a substantially horizontal, lowered operational position by support rods 142 which slidably extend through a common swiveling pin 144 that is rotatably mounted on rear post member 43 with a bracket 146. Support rods 142 are retained in swiveling pin 144 by nuts 147 mounted on the corresponding forward ends of support rods 142. The other end of each support rod 142 extends through a slot 160 in platform 26 and is rotatably attached to a bracket 148 securely mounted on the bottom of platform 26. When not in use, as shown in phantom lines in FIG. 2, platform 26 can be raised to a vertical, stowed position and retained there with a latch 150.

In operation, the present invention provides a lift device that can transport a patient safely beyond the support area 17. An operator would push lift device 10 to the place where the patient is first located and would operate smaller hand wheel 120 to position trolley assembly 20 to a position abutting end plate 52 on boom assembly 18, a location that is outside support area 17. The operator would then lower platform 26 and stand on the platform while operating larger hand wheel 112 so as to lower sling 96 to enable a patient to get into the sling. The rotational moment of an operator mounted on platform 26 acts through a distance from the operator's position on platform 26 to the pivot point or fulcrum which is located at front wheels 14. The counter-rotational moment exerted by a patient that is positioned in sling 96 acts through the much shorter distance from the end of boom assembly 18 to the same front wheels 14. Thus, a 70 pound operator can safely counter the weight of a 250 pound patient. As a result of the aforedescribed mechanical advantages and the rotational linkage between hand wheels 112 and 120 and threaded shaft 124 and square shaft 98, as little as a 2½ pound effort is required to lift a 250 pound patient and to move the patient to a location inside of support area 17.

Once a patient has been moved within the support area 17, the operator can descend from platform 26 and stow platform 26 in its upright position. The patient can then be easily transported to another area such as to a bathroom. The front of lower base assembly 30 can be placed in contact with the vertical wall of a bathtub and the patient can be easily and safely lowered into the bathtub by reversing the aforedescribed procedure. All the operator has to do is to lower and mount platform 26 and then operator hand wheels 120 and 112 to position the patient over the bathtub and lower the patient down into the bathtub.

In a preferred embodiment of the present invention, the height of boom assembly 18 and the width of base assembly 30 are selected so that lift device 10 can be easily transported through standard sized door openings. The length of track 54 is preferably selected such that a 15 inch length extends beyond front wheels 14.

Thus, the present invention provides a sturdy, relatively inexpensive and mechanically simple patient lift device that is easily operated and can be used to position a patient into or onto an object that is located in front of the base assembly of the lift device. Although a manually operated lift device was thoroughly described above, an electrically operated lift device is still within the scope of the present invention.

Although the invention has been described in detail with respect to an exemplary embodiment thereof, it will be understood by those of ordinary skill in the art that variations and modifications may be effected within the scope and spirit of the invention.

I claim:

1. A patient lift device comprising a support assembly;

an elongate, substantially horizontal boom assembly supported by said support assembly and comprising a substantially horizontal track;

movable suspension means for suspending a means for holding a patient comprising a travelling trolley assembly mounted on and movable over said track, said trolley assembly comprising a rigid frame and a plurality of wheels rotatably mounted to said frame at the upper ends thereof for movable engagement with said track, said frame having a threaded orifice therein, the axis of which extends in the longitudinal direction, and vertical adjustment means for vertically moving the patient holding means comprising a drum horizontally rotatably mounted to and carried by said trolley assembly, a flexible cable means having one end wound around said drum and the other end for connecting to the patient carrying means and means for rotating said drum for raising and lowering the other end of said cable, said drum rotating means comprising an elongate member rotatably mounted on said boom assembly and means for rotating said elongate member, and wherein said drum has a central bore completely therethrough for slidably mounting said drum on said elongate member and is keyed to said elongate member such that rotation of said elongate member results in rotation of said drum;

and horizontal adjustment means for horizontally moving said trolley assembly along said track comprising a rotatably mounted threaded shaft in threaded engagement with said trolley assembly and means for rotating said threaded shaft such that rotation thereof results in axial movement of said trolley assembly with said drum along said track, said threaded shaft rotating means comprising an upstanding post assembly rigidly mounted to said support assembly, a first hand wheel rotatably mounted on said post assembly and linkage transferring the rotation of said hand wheel to said threaded shaft, and said elongage member rotating means comprises a second hand wheel concentrically rotatably mounted with said first hand wheel and linkage transferring the rotation of said second hand wheel to one end of said elongate shaft, said device further comprising a platform mounted to said support assembly at the location where said post assembly is mounted to said support assembly, said support assembly having a control station located where said post assembly is mounted to said support assembly, and said hand wheels being operable by an operator of said lift device when supported by said platform.

2. The device as claimed in claim 1 wherein said support assembly comprises a lower base assembly, means for movably supporting said base assembly on a supporting surface such as a floor, said movable support means outlining the periphery of a support area, and an upstanding post assembly rigidly mounted at one end thereof at one end of said base assembly; and wherein said boom assembly comprises a cantilever boom rigidly mounted at the other end of said post assembly for carrying said track, said boom and said track extending in a substantially horizontal first direction beyond the other end of said base assembly and said support area; said device further comprising a stabilizing means which comprises a cantilever platform mounted to said one end of said base assembly and extends longitudinally therebeyond in the other horizontal direction for supporting an operator of said lift device for counterbalancing the weight of the patient when said suspension means is moved beyond said support area.

3. The device as claimed in claim 1 wherein said threaded shaft rotating means comprises a first hand wheel rotatably mounted on said post assembly and linkage transferring the rotation of said hand wheel to said threaded shaft, and said elongate member rotating means comprises a second hand wheel concentrically rotatably mounted with said first hand wheel and linkage transferring the rotation of said second hand wheel to one end of said elongate shaft, said hand wheels being operable by an operator of said lift device when supported by said platform.

4. A movable patient lift device comprising a support assembly which also defines the outer perimeter of a support area, said support assembly comprising a lower base assembly and an upstanding post assembly mounted at one end thereof to one end of said base assembly and having a control station located at said one end of said base assembly from which an operator can operate said lift device;

first means attached to said support assembly for permitting movement of said lift device along a supporting surface, said first means outlining the periphery of said support area;

an elongate, substantially horizontal boom assembly supported by said support assembly and extending beyond said support area in a first longitudinal direction, said boom assembly comprising a cantilever boom rigidly mounted at the other end of said post assembly and extending in a substantially horizontal direction beyond the other end of said base assembly and said support area and including a substantially horizontal track;

movable suspension means mounted on and movable over said track for suspending a means for carrying a patient comprising vertical adjustment means for vertically moving the patient carrying means, said vertical adjustment means including means located at said control station for controlling the vertical movement of the patient carrying means;

horizontal adjustment means mounted to said boom assembly for horizontally transporting said suspension means along said boom assembly beyond said support area and comprising a threaded shaft rotatably mounted on said boom, one end of said shaft extending beyond said support area, said suspension means being in threaded engagement with said shaft, said horizontal adjustment means further comprising means for rotating said shaft which rotation is turn causes movement of said suspension means along said track, said rotating means comprising means located at said control station for controlling the rotation of said shaft; and stabilizing means mounted at said one end of said base assembly for counterbalancing the weight of the patient when said suspension means is moved beyond said support area, said stabilizing means comprising a cantilevered platform located at said control station and mounted to said one end of said base assembly and extendable beyond said support area in the other longitudinal direction, whereby an operator standing on said platform provides the counterbalancing weight.

5. The device as claimed in claim 4 wherein said stabilizing means comprises a cantilever platform pivotably mounted to said base assembly.

6. The device as claimed in claim 4 wherein said base assembly comprises a substantially horizontal U-shaped frame having a base and two substantially parallel arms and wherein said post assembly is rigidly mounted at approximately the transverse center of said base and wherein said first means comprises a plurality of roller means rotatably mounted to the bottom of said frame.

7. The device as claimed in claim 4 wherein said boom assembly includes a substantially horizontal track, said suspension means further comprises a travelling trolley assembly mounted on and movable over said track and said vertical adjustment means includes a drum horizontally rotatably mounted to and carried by said trolley assembly, a flexible cable means having one end wound around said drum and the other end for receiving a patient carrying means, and means for rotating said drum for raising and lowering the other end of said cable.

8. The device as claimed in claim 7 wherein said trolley assembly comprises a linkage member having a threaded orifice therein for mating with said threaded shaft such that upon rotation of said threaded shaft, said trolley assembly is moved in the longitudinal direction.

9. The device as claimed in claim 8 wherein said drum rotating means comprises an elongate member rotatably mounted on said boom assembly and extending beyond said support area at one end thereof and means for rotating said elongate means, and wherein said drum has a central bore completely therethrough for slidably mounting said drum on said elongate member and is keyed to said elongate member such that rotation of said elongate member results in rotation of said drum and rotation of said threaded shaft results in axial movement of said trolley assembly and said drum along said elongate member.

10. The device as claimed in claim 7 wherein said trolley assembly comprises a rigid frame having two spaced apart side plates and two spaced apart end plates and a plurality of wheels rotatably mounted to said side plates at the upper ends thereof for movable engagement with said track and each said plate has a threaded orifice therein colinearly aligned with the other orifice and said threaded shaft is in threaded engagement with said threaded orifices.

* * * * *